US009845801B1

(12) United States Patent
Shek

(10) Patent No.: US 9,845,801 B1
(45) Date of Patent: Dec. 19, 2017

(54) HEADER RING FOR RECIPROCATING PUMP

(71) Applicant: Fast Group-Houston, Inc., Humble, TX (US)

(72) Inventor: Lee Shek, Houston, TX (US)

(73) Assignee: Fast Group-Houston, Inc., Humble, TX (US)

( * ) Notice: Subject to any disclaimer, the term of this patent is extended or adjusted under 35 U.S.C. 154(b) by 0 days.

(21) Appl. No.: 13/733,749

(22) Filed: Jan. 3, 2013

Related U.S. Application Data

(60) Provisional application No. 61/582,645, filed on Jan. 3, 2012.

(51) Int. Cl.
*F02F 5/00* (2006.01)
*F04B 53/02* (2006.01)

(52) U.S. Cl.
CPC ..... *F04B 53/02* (2013.01)

(58) Field of Classification Search
CPC ..... F16J 9/26; F16J 15/16; F16J 15/34; F16J 15/15; F16J 15/164; F16J 15/3264; F16J 15/344; F16J 15/166; F16J 15/20; F16J 15/24; F16J 15/3216; F04B 53/02; F04B 39/04; F04B 39/12; F04B 53/16
USPC ..... 277/434, 500, 511, 529, 532, 534, 540
See application file for complete search history.

(56) References Cited

U.S. PATENT DOCUMENTS 3,970,321 A * 7/1976 Dechavanne ..... 277/556
3,980,309 A * 9/1976 Dechavanne ..... 277/550
4,066,269 A * 1/1978 Linne ..... 277/575
4,440,404 A 4/1984 Roach et al.
4,474,382 A 10/1984 Hjelsand
5,230,520 A 7/1993 Dietle et al.
5,380,016 A * 1/1995 Reinsma et al. ..... 277/503
5,431,415 A 7/1995 Millonig et al.
5,738,358 A * 4/1998 Kalsi ..... F16J 15/164 277/544
5,842,701 A * 12/1998 Cawthorne ..... E21B 10/25 277/336

(Continued)

FOREIGN PATENT DOCUMENTS

WO 99/50578 10/1999

*Primary Examiner* — Nathan Cumar
(74) *Attorney, Agent, or Firm* — Shumaker, Loop & Kendrick, LLP

(57) ABSTRACT

A new header ring useful in downhole packing sets automatically cleans the cylinder plunger wall during use and forms an improved seal having long duration. The new header ring has a ring shaped body. The body includes a side wall defining an open top, an open bottom, and an inner wall portion with an inner wall surface for contacting a plunger. The inner wall portion includes an outwardly extending annular undercut, which defines an overhang and radius that helps wipe clean the plunger wall and form a better seal. The body also has an outer wall portion with an outer wall surface for contacting a stuffing box wall. The outer wall has a flat upper portion, a flat lower portion, and an outwardly sloped annular middle portion connecting the top and lower portions. The outer wall also has an inwardly extending annular ledge formed in its bottom. The inner wall portion is formed from a high wear resistance elastomer, and the outer wall portion is formed from a nonabrasive elastomer.

5 Claims, 4 Drawing Sheets

(56) References Cited

U.S. PATENT DOCUMENTS

| | | | | |
|---|---|---|---|---|
| 6,170,830 | B1 * | 1/2001 | Cawthorne | E21B 10/25 277/336 |
| 6,209,882 | B1 | 4/2001 | Riess | |
| 7,461,708 | B2 * | 12/2008 | Yong et al. | 175/371 |
| 7,562,878 | B2 | 7/2009 | Dietle et al. | |
| 8,201,832 | B2 | 6/2012 | Kocurek | |
| 2009/0166980 | A1 * | 7/2009 | Miller | F16J 15/166 277/529 |

* cited by examiner

HEADER RING FOR RECIPROCATING PUMP

REFERENCE TO RELATED APPLICATION

This application claims priority to U.S. Provisional Application No. 61/582,645, filed Jan. 3, 2012, which is hereby incorporated by reference.

BACKGROUND OF THE INVENTION

1. Field of the Invention

The invention relates generally to seals and, more particularly, to a header ring for a reciprocating pump.

2. Description of the Prior Art

Hydraulic fracturing is used for removal of petroleum, natural gas, coal seam gas and other flowable substances from beneath the earth's surface. Highly pressurized fluid is forced into a wellbore to create new fractures in a rock layer. After creating the fracture it is desirable to maintain the fracture width since this increases extraction rates and recovery of fossil fuels. Thus, material such as sand, ceramic, or other particulate, which is known as proppant, is mixed with the fluid and forced under pressure into the fracture to keep it open. The abrasive nature of the particulates, however, wreaks havoc on the piston/cylinder assemblies of the high-pressure pumps used in "fracking."

When the particulates are allowed between the walls of the bore/plunger assemblies, loss of pressure results. Keeping them from reaching between the bore and cylinder plunger, therefore, is essential for seal duration. Well service packing (WSP) is typically used to seal the gap and permit slidable engagement. The packing is a collection of ring-shaped seals contained in a bore, known in the art as a "stuffing box," and arranged in order so as to incrementally ride against the wall of the plunger and seal it at the fluid end. The bore receives the reciprocating plunger making replacement of all of the seals, which often must be done in the field, more manageable and convenient. The seals typically comprise a header ring at the fluid end and at least a pressure ring behind it. The header ring is especially important in providing a good seal since it is toward the fluid end and bears much of the abuse.

At the time of this writing, frictional wear of the header ring is perhaps at its worst. This is because the proppant now preferred in frac jobs has become smaller and smaller in size. To make matters worse, the seal has to withstand a range of different fluid pHs, too. That is, the pressurized fluid may be cement (mildly acidic) instead of water (neutral), for example. The material from which the seals are made, therefore, must be matched with a set of desired physical properties. Prior seals are made from elastomeric composites, which can be abrasive to the stuffing box even if there is no proppant between the seal and box. The seals are subjected to extremely high pressures and a broad range of operating temperatures as well. Hence, wear and tear of the seals are constant concerns.

Besides problems caused by not properly cleaning the contacting surfaces when replacing seals in the field, sealing problems are exacerbated by the mechanics of the stuffing box. Packing is secured in the box mechanically and secured about the plunger with a gland nut. If the nut is too tight, the header ring, which may be formed from a compressible material, may be extruded back into the fluid end, and the seal will fail. Conversely, if the gland nut is too loose, the seal assembly will move back and forth in the stuffing box causing wear and eventual failure of the seal. Assuming the gland nut is properly secured, still, it may back off due to vibration of the pump. As a result, the contact load on the header ring is insufficient to adequately seal the fluid end of the wellbore.

There, therefore, remains a need for an improved header ring and sealing system for a reciprocating pump. The present invention is directed toward meeting this need.

SUMMARY OF THE INVENTION

The invention relates to a header ring for a reciprocating pump. The header ring includes a ring shaped body. The body has a side wall defining an open top and an open bottom and an inner wall portion with an inner wall surface for contacting a plunger. The inner wall portion includes an outwardly extending annular undercut, which defines an overhang. The inner wall portion includes an annular shoulder, an inwardly sloped portion and a flat portion. The header ring also has an outer wall portion with an outer wall surface for contacting a bore wall, which is typically a stuffing box containing sealing rings. The outer wall portion includes a bottom with an inwardly extending annular ledge. The outer wall portion is formed from a nonabrasive elastomer.

In another aspect of the invention, the inner wall includes an inwardly directed annular shoulder adjacently spaced from and in alignment with the undercut. The shoulder is located between the undercut and the top of the body.

In another aspect, the outer wall portion and the inner wall portion are each formed of an elastomer having a durometer of between about 70 and 95 Shore A. The inner wall portion is harder than the outer wall portion.

In still another aspect, the outer wall portion includes a flat upper portion, a flat lower portion, an outwardly sloped annular middle portion connecting the upper and lower portions. An inwardly extending annular ledge is formed in the bottom of the outer wall portion.

One object of the present invention is to provide an improved header ring for a reciprocating pump. Related objects and advantages of the invention will become apparent from the following description.

DETAILED DESCRIPTION OF INVENTION

Figure 1:
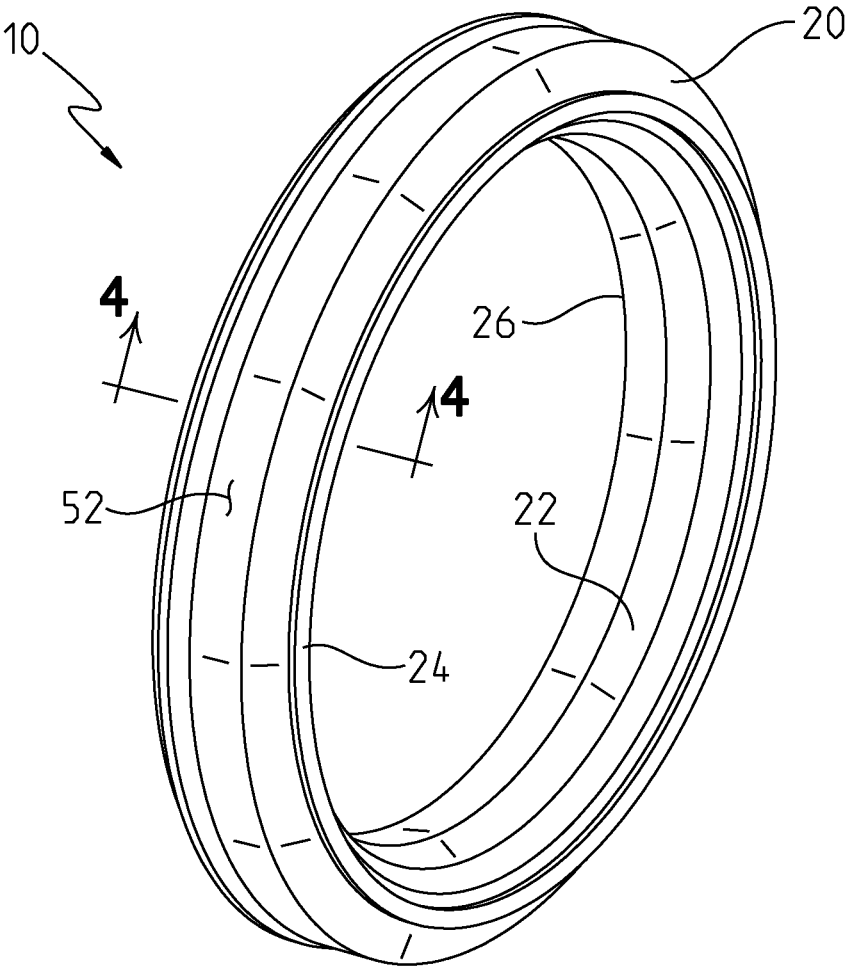
FIG. 1 is an isometric view of an embodiment of the header ring of the invention.

Referring to the Figures, one embodiment of the invention provides a header ring 10 for a reciprocating pump. The ring shaped body 20 has a side wall 22 that defines an open top 24 and an open bottom 26. The cross section, (FIG. 4) shows an inner wall portion 30 with an inner wall surface 32 for contacting a plunger pump 12. The inner wall portion 30 includes an annular undercut 34 angled upward and outward that defines an overhang 35. The undercut has a radial portion 37 that connects the undercut with the pedestal or foot of the bottom 26 of the body 20.

Figure 4:
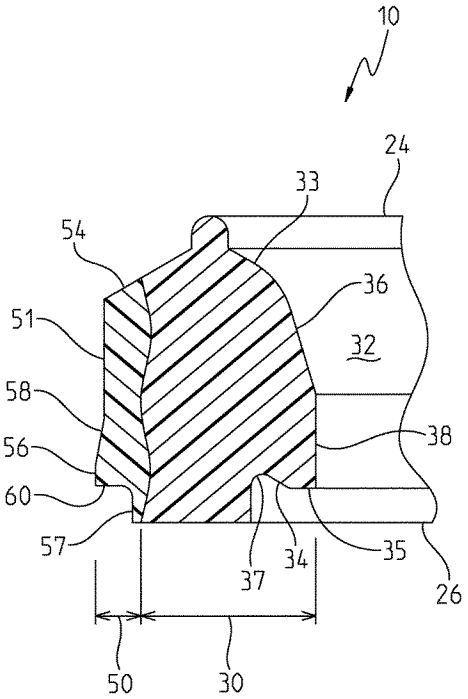
FIG. 4 is an enlarged cutaway cross sectional view of the header ring of the invention taken along lines 4-4 of FIG. 1.

An inwardly directed annular shoulder 33 is adjacently spaced from the undercut 34 and radial portion 37. The shoulder may be shaped so as to be in direct alignment with the undercut 34, the radial portion 37, or both the undercut 34 and the radial portion 37, like the embodiment of FIG. 4. The shoulder 33 is located between the undercut and the top 24 of the body. The inner wall portion 30 also has an inwardly sloped portion 36 and a flat portion 38. The flat portion 38 is shown in FIG. 4 as substantially parallel with the vertical, but in another embodiment, the flat portion may be formed inwardly or outwardly at an angle of between about minus 15 degrees (−15°) and fifteen degrees (15°) relative to the vertical (0°). In more preferred embodiments the flat portion 38 is formed in a manner such that it is angled inwardly (relative to the vertical showing in FIG. 4) toward the plunger wall 12 (FIG. 5) to between about zero (0°) and fifteen degrees (15°).

The body 20 includes an outer wall portion 50 with an outer wall surface 52 for contacting a bore wall 40, which in typical applications is the wall of a stuffing box. Both the outer wall portion 50 and the inner wall portion 30 may be thicker or thinner than depicted in FIG. 4. The outer wall portion has an outwardly and downwardly directed sloped top portion 54, a flat upper portion 51, a flat lower portion 56, and an outwardly sloped annular middle portion 58 connecting the upper and lower portions 51, 56. In the embodiment illustrated in FIG. 5, the outer wall portion 50 includes a bottom 57 with an outwardly extending annular ledge 60.

In some embodiments, the outer wall 50 and the inner wall 30 may be formed as a homogeneous elastomer ring. The body 20 can be made from a number of different natural or synthetic rubbers as, for example, nitrile or butadiene rubber, with a desired degree of hardness depending upon the use to which the plunger pump 12 is exposed. The outer wall 50 and the inner wall 30 may each be formed from an elastomer having a durometer of between about seventy (70) and ninety-five (95) Shore A. In another embodiment, the inner wall 30 and the outer wall 50 are formed from different materials, and the inner wall is harder than the outer wall.

In some embodiments, the header ring 10 or at least a portion thereof is formed from ultra-high-molecular-weight polyethylene (UHMWPE), e.g., perfluoroalkoxy (PFA), polyurethane, and/or other thermo or thermoset plastics. In other embodiments, the header ring or at least a portion thereof is formed from a fluorinated polymer, e.g., polytetrafluoroethylene (PTFE)-based material, fluorinated ethylene propylene (FEP).

In yet another embodiment the header ring 10 or at least a portion thereof is formed from a rigid and/or nonrigid composite elastomer using known means. Some portions and parts of the header ring 10 may, in some embodiments, be harder than others and/or have various values of hardness and include materials, such as fiber, filler or elastomer coated fabric, for example, to yield desirable physical properties driven by the particular environment of the application, such as ambient temperatures, pressures or pHs. In one embodiment, the header ring 10 or at least a portion thereof is formed from a fluorocarbon.

The above materials, compositions, and/or constituent elements forming the particular plastics discussed and their corresponding physical properties, however, should not be construed as limiting. Other materials, compositions, and/or constituent elements forming rigid and non-rigid materials or plastics possessing the physical properties useful in a manner as herein described may be appropriately desirable and availed using different materials, compositions, and/or constituent elements without undue experimentation and should be considered to fall within the scope of Applicants' innovative header ring.

In more preferred embodiments, the inner wall portion 30 is formed from a high wear resistance/self-lubricated fluoroelastomer (FKM (FPM by ISO)) having a coefficient of friction between about 0.05 to 0.10, e.g., VITON®, and which may withstand pressure cycles of up to 20,000-30,000 psi; and the outer wall portion 50 is formed from a non-abrasive elastomer preferably containing graphite and/or rubber constituents, e.g., Hydrogenated Nitrile Butadiene Rubber (HNBR). A softer outer wall 50 substantially reduces the wear on the wall of the stuffing box 14 and prolongs the life of the seal 10 as a result. The softer outer wall 50 also produces inward radial force against the plunger 12 pump so that the inner wall surfaces 32, 38, 35, 34 and 37 define the self-sealing mechanism described below.

Figure 2:
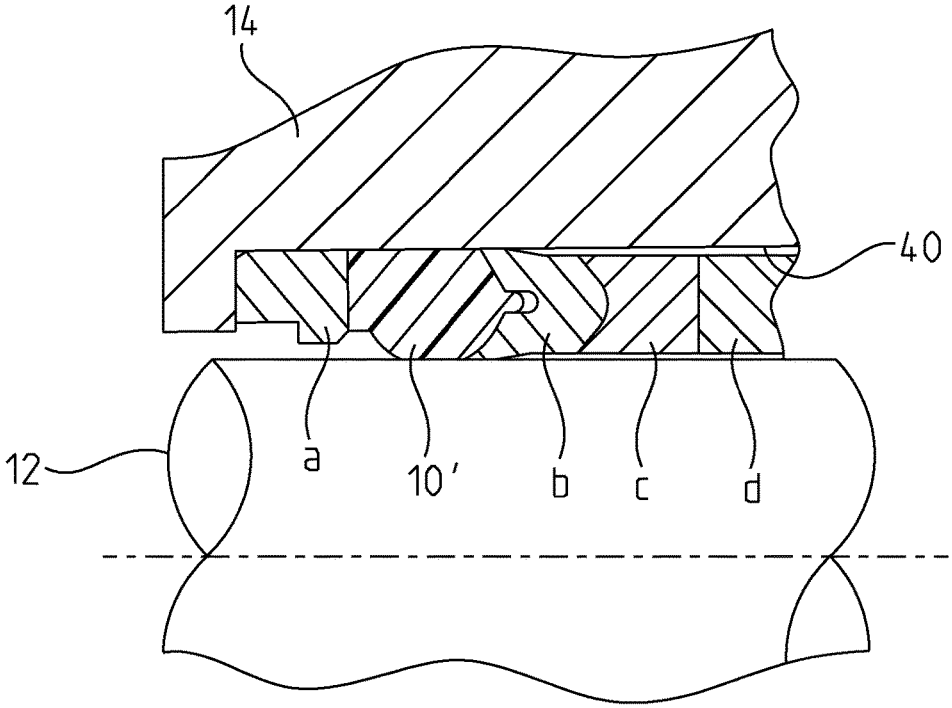
Fig. 2 Prior Art
FIG. 2 is a partial cross sectional view that shows an exemplary down hole packing set in horizontal showing a prior art header ring and other seals in the casing contacting the plunger on the interior and the bore or stuffing box wall on the exterior. The packing set includes a junk ring a, a header ring b, a pressure ring c, and a top adaptor ring d, which is partially cut away.
Figure 3:
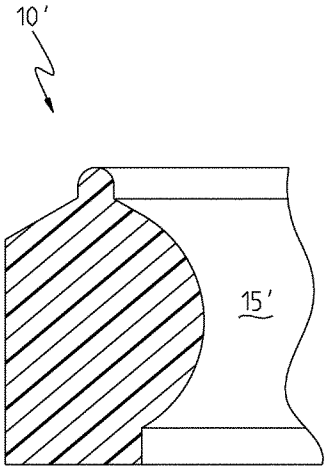
Fig. 3 Prior Art
FIG. 3 is an enlarged cutaway cross sectional view of the prior art header ring shown in FIG. 2.

FIG. 2 shows an example of a prior well service sealing system or packing set illustrating diagrammatically different ring components (in cross section) a-d contained in a stuffing box 14. The pump plunger 12 travels through the bore defined by the seals a, 10' and b-d. The header ring 10' shown in FIGS. 2-3 is a prior art device and has a curved inner wall surface 15' that is made to press against the plunger wall 12 to form a seal and a flat outer wall, as best seen in FIG. 2. Skilled artisans are familiar with the limited effective sealing life of the system created between the prior ring 10' and the plunger 12 on the one side, and the ring 10' and the wall 40 of the stuffing box 14 on the other. Regardless of the direction (in or out) of the plunger, sealing action delivered by the prior homogeneous elastomer ring 10' against the respective surfaces of the plunger and stuffing box are the same in each direction. As a result, seal life is not optimal.

Figure 5:
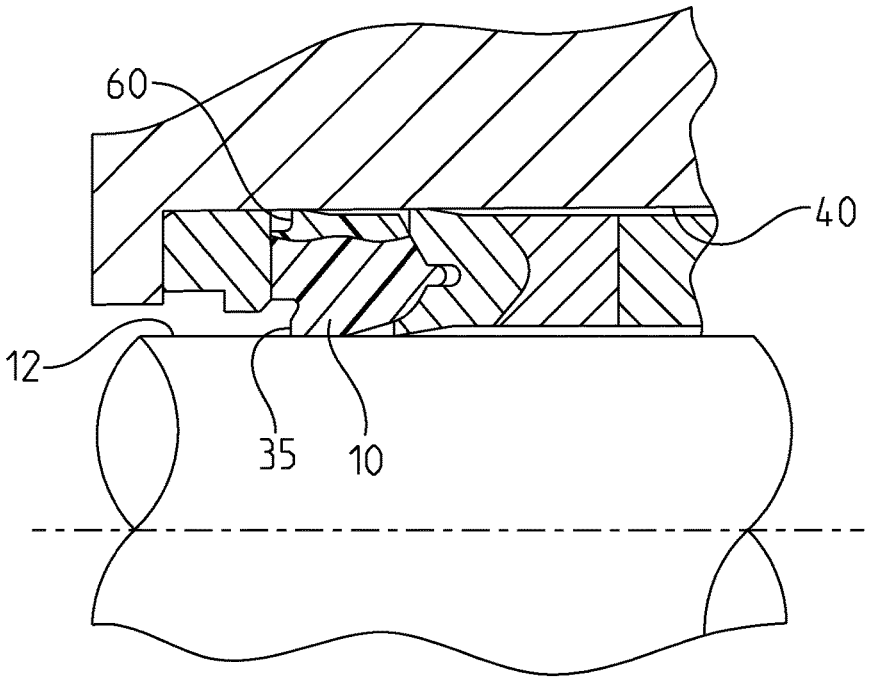
FIG. 5 is a partial cross sectional view like the one of FIG. 1 with the new header ring of the invention substituted for the prior art header ring.

Referring to FIGS. 4-5, the automatic cleaning function of the ring 10 is described. When a sealing system or "packing" that includes the new header ring 10 is installed into the stuffing box, the unique geometry of the softer outer wall 50, specifically the flat lower portion 56 and annular ledge 60 compresses against and automatically wipes/cleans the wall 40 of the stuffing box 14. The wall 40 of the box is thus kept clean and sealed as these surfaces 56, 60, unlike the plane surface of the outer wall of the prior ring 10', provide different sealing actions against the wall of the stuffing box 14 when they are made to agitate ("washboard") coincident with in/out motion of the plunger 12 pump.

Additionally, the compressive force to the softer outer wall 50 produces an inward radial force against the inner wall 30 that significantly improves seal function and duration. Flat portion 38 compresses radially against the wall of the plunger 12. The amount of surface area of flat portion 38 made to contact the plunger wall 12 and hence, the effectiveness of the seal, is determined by the angle of flat portion 38 relative to the vertical, as described above. The radial force is transferred to portion 38, overhang 35, undercut 34 and radius 37, which together form a self-sealing function between the ring 10 and the plunger 12 pump. Compression force on portion 38 causes the inner wall 30 to give slightly at radius 37 causing the wiper or sharp-edged overhang 35 and portion 38 to firmly seal with more or less force against the plunger 12. Thus, a sharp wiping with less surface area contact or a full flat portion 38 optimal surface area contact may be used as desired.

On the upward stroke of plunger 12, the overhang 35, undercut 34 and radius 37 wipe and guide dirt and debris from the plunger keeping it free of silica, ceramic or other particulate that may cause leaks or damage to the packing. The new header ring 10 makes replacement of the packing more convenient because the "wipers" 60, 35 make walls 40, 12, self-cleaning. That is, workers don't have to wrestle with cleaning the stuffing box and plunger in the field when replacing the packing.

For the purposes of promoting an understanding of the principles of the invention, specific embodiments have been described. It should nevertheless be understood that the description is intended to be illustrative and not restrictive in character, and that no limitation of the scope of the invention is intended. Any alterations and further modifications in the described components, elements, processes, or devices, and any further applications of the principles of the invention as described herein, are contemplated as would normally occur to one skilled in the art to which the invention relates.

The invention claimed is:

1. A header ring adapted to be positioned between a bore wall and a reciprocating plunger, comprising:

an annular body having an inner portion adapted to contact the reciprocating plunger without contacting the bore wall, and an outer portion adapted to contact the bore wall without contacting the reciprocating plunger, the inner portion including an inner wall adapted to be positioned contacting the reciprocating plunger and having a flat face oriented parallel to a reciprocating plunger axis, a radially inwardly sloped portion and annular shoulder positioned to one side of the flat face, and an annular undercut providing an overhang and diametrically reduced portion positioned to the other side of the flat face, the undercut being radially inward of a portion of the flat face such that one end of the flat face overhangs the undercut to define a first wiper on a leading end of the inner wall, and the outer portion including an outer wall adapted to be positioned contacting the bore wall and having a flat face parallel to the flat face of the inner wall, an outwardly sloping face to one side of the flat face, and an annular ledge to one side of the outwardly sloping face, the annular ledge extending radially outward of and perpendicular to a bottom of the outer portion, the bottom oriented perpendicular to a leading end of the outer portion, the annular ledge and the bottom defining a second wiper on the leading end of the outer wall;

wherein the first and second wipers are disposed on opposite sides of the leading end of the header ring and clearance is provided adjacent each of the first and second wipers adapted to collect debris wiped from each of the respective reciprocating plunger and bore wall.

2. The header ring according to claim 1, wherein the annular shoulder is spaced apart from the annular undercut.

3. The header ring according to claim 1, wherein the outer wall and the inner wall each include an elastomer having a durometer of between 70 and 95 Shore A, and wherein the inner wall is harder than the outer wall.

4. A header ring according to claim 1, wherein the outer wall further comprises a second flat face spaced from the flat face by the outwardly sloping face.

5. The header ring according to claim 1, wherein the inner wall comprises a high wear resistance elastomer, and the outer wall comprises a nonabrasive elastomer.

* * * * *